US005938131A

United States Patent [19]

Thom, Jr. et al.

[11] Patent Number: 5,938,131

[45] Date of Patent: Aug. 17, 1999

[54] HAMMERMILL WITH POLYGONAL SCREEN, REGRIND DEFLECTORS AND HINGED DOOR MOUNTING SCREEN SECTIONS

[75] Inventors: Kelsey C. Thom, Jr., Litchfield, N.H.; Ted Waitman, Waverly; Heath L. Hartwig, Waterloo, both of Iowa

[73] Assignee: Consolidated Process Machinery, Inc., Merrimack, N.H.

[21] Appl. No.: 08/857,286

[22] Filed: May 16, 1997

[51] Int. Cl.[6] ..... B02C 13/284

[52] U.S. Cl. ..... 241/73; 241/189.1; 241/285.2

[58] Field of Search ..... 241/189.1, 73, 241/194, 285.2

[56] References Cited

U.S. PATENT DOCUMENTS

| | | | |
|---|---|---|---|
| 1,737,444 | 11/1929 | Wilson | 241/73 |
| 3,040,794 | 6/1962 | Jacobsen et al. | 241/73 |
| 3,791,073 | 2/1974 | Baker | 49/249 |
| 4,202,503 | 5/1980 | Parkinson et al. | 241/194 |
| 4,318,512 | 3/1982 | Jacobson et al. | 241/73 |
| 4,449,673 | 5/1984 | Cameron | 241/186 |
| 4,697,743 | 10/1987 | Bjorck et al. | 241/5 |
| 5,036,757 | 8/1991 | Mueller | 99/519 |
| 5,503,338 | 4/1996 | Thom | 241/73 |
| 5,692,688 | 12/1997 | Waitman et al. | 241/73 |
| 5,829,692 | 11/1998 | Walters | 241/62 |

FOREIGN PATENT DOCUMENTS

| | | | |
|---|---|---|---|
| 75 27403 | 4/1977 | France | 241/189.1 |
| 1812162-A1 | 4/1993 | Russian Federation | 241/189.1 |

OTHER PUBLICATIONS

"The World Leader in Particle Size Reduction," Roskamp Champion brochure (date unavailable).

*Primary Examiner*—Joseph J. Hail, III
*Assistant Examiner*—Susan R. Kingsbury
*Attorney, Agent, or Firm*—Nixon & Vanderhye

[57] ABSTRACT

The hammermill includes a housing, a working chamber defined by a polygonal screen, an inlet to the chamber, an outlet and a plurality of free-swinging hammers attached to a driven rotor. Support brackets extend the length of the housing and mount deflectors for eliminating tangential motion of materials being comminuted in the working chamber in the region of the deflectors. Side doors mount screen carriages for movement toward and away from the doors. In a closed position of the door, springs bias the screen carriages into engagement with wear-linings and the support brackets. The doors are pivotal away from the housing for access to the screens and the interior of the working chamber. A bottom screen carriage is movable toward and away from the chamber for access to the bottom screen sections.

22 Claims, 9 Drawing Sheets

26
80
18
A
42
27
16
28
49
40
24
47
20
23
B
32
30
45
27
44
46
C

HAMMERMILL WITH POLYGONAL SCREEN, REGRIND DEFLECTORS AND HINGED DOOR MOUNTING SCREEN SECTIONS

TECHNICAL FIELD

The present invention relates generally to hammermills and particularly to a polygonal screen configuration with deflectors for increasing the efficiency of the comminution of the materials and a hinged door carrying the screens and facilitating access to the working chamber of the hammermill and the hammers, as well as replacement of damaged screens.

BACKGROUND

Hammermills are used for grinding or comminuting materials such as corn. Typically, a hammermill consists of a housing having a feed material inlet at the top, a grinding or working chamber below the feed material inlet and a ground material outlet below the working chamber. The working chamber is usually defined by an apertured screen extending downwardly from one edge of the feed material inlet and curving about to form a partly cylindrical surface before extending upwardly to the opposite edge of the inlet. The cross-sectional shape of the chamber is roughly a teardrop formed by a circular lower portion mounted by two straight lines converging upwardly toward the edges of the feed material inlet. The apertured screen defines the walls of the working chamber and surrounds a rotor mounted coaxially in the cylindrical portion of the grinding chamber. A number of hammers are pivotally mounted on the rotor for free-swinging movement under centrifugal force when the rotor is rotated. During rotation, the tips of the hammers pass closely along the surface of the apertured screen, impacting upon the feed materials and hence comminuting the materials until the particles are sufficiently fine to pass through the apertured screen to the particle outlet.

During grinding, however, the particles impacted by the hammers quickly attain the velocity of the hammers tangentially of the screen surface. This is partly due to the impact and partly due to the fanning action of the rotor on the air in the working chamber. Also, the low angle of contact of the particles with the screen prevents passage of even properly sized particles through the apertures so that the particles travel along the screen surface at approximately the same velocity as the hammer tips. This results in a very low number of large energy impacts and an unsatisfactory production rate. Regrind deflectors have been proposed to alleviate this problem, the deflectors being circumferentially spaced about the circular screen to deflect the material inward for higher energy impacts. Such deflectors are disclosed in U.S. Pat. No. 5,503,338. Polygonal-shaped screens have also been proposed to increase the high energy impact of the hammers on the material. See, for example, U.S. Pat. No. 5,692,688, issued Dec. 2, 1997 common assignee herewith.

Further, hammermill screens frequently become damaged by the impact of the particles and through normal wear and tear. The screens must be periodically replaced and, of course, replaced upon the occurrence of a substantial tear in the screen. Screen replacement is oftentimes laborious and time-consuming, and incurs downtime costs for the hammermill. Automatic screen changers have been proposed and constructed but are quite expensive and compromise the structural integrity of the hammermill. Clamp-in screen carriages have also been proposed and constructed but are often difficult to handle due to their size and weight. Additionally, they do not ensure complete edge clamping due to the tangential positions of the clamp.

DISCLOSURE OF THE INVENTION

According to the present invention, there is provided a hammermill having improved comminuting efficiencies, access to the rotor and hammers, and improved screen replacement capability. A hammermill constructed in accordance with the present invention includes a housing having a material feed inlet for feeding material into a working chamber defined by a polygonal-shaped screen (as viewed axially), the screen including a multiplicity of screen sections, and an outlet for removing the ground material. Preferably, the screen sections are combined on opposite sides and at the bottom of the working chamber to provide two side screen segments and a bottom screen segment, each segment being carried by a screen carriage. It will be appreciated that the polygonal shape of the screen improves hammer impact and crushing efficiency by inhibiting the acceleration of the particles in a tangential direction of hammer rotation by flow interruptions caused by the irregular shape of the polygonal screen, thus increasing the particle-to-hammer speed differential and crushing efficiency. The present invention provides in addition deflectors at the juncture of one or more of the screen sections of the polygonal-shaped screen as part of the screen mounting structure. The deflectors serve to not only support the screen but also, at one or more of the junctures of the screen sections, effectively preclude tangential particle motion and provide radial components to particle travel, thereby improving particle breakdown efficiency.

Additionally, the present invention provides a hinged door on each of the opposite sides of the hammermill to facilitate access to the interior working portions of the hammermill, i.e., the rotor and hammers, as well as screen replacement. Each door carries a side carriage which in turn mounts a side screen segment. Preferably, three screen sections are carried by the side carriages and two screen sections by a bottom carriage, not part of either door. Resilient elements interconnect the door and screen carriage to enable horizontal movement of the screen carriage relative to the door. Each door carries its carriage for movement with the door between a closed position with the carriage and screen segment bearing against wear-liners at opposite ends of the hammermill housing and an open position with the carriage and screen segment oriented at right angles to the axis of rotation of the hammermill. To accomplish this, each door is pivotally mounted substantially along a mid-line thereof to one end of a support which, in turn, is pivotally mounted at its opposite end to the housing. By such mounting, each door and screen carriage and screen sections carried thereby can be displaced from the closed position in a lateral direction generally linearly away from the hammermill and thereafter can be rotated relative to the support to a position orienting the door, screen carriage and screen sections generally at right angles to the axis of the hammermill. This not only facilitates access to the screen sections and carriage for replacement but also enables easy access to the interior of the working chamber of the hammermill. When the door is pivoted into the closed position and clamped shut, the screen carriage engages wear-liners at opposite ends of the housing and is displaced a limited distance horizontally relative to the door against the bias of the resilient elements enabling a compliant tight fit with the wear-liners and accommodating screen sections of different thickness.

The bottom screen carriage is also movable toward and away from the working chamber to facilitate bottom screen section change-outs. The bottom screen carriage is biased into its closed position and can be locked against the bias in its open position.

In a preferred embodiment according to the present invention, there is provided a hammermill for comminuting material, comprising a housing having an inlet for receiving material to be comminuted, a rotor within the housing and mounted on a driven shaft, a plurality of free-swinging hammers attached to the rotor, a polygonal apertured screen mounted about the rotor and defining a working chamber for receiving material to be comminuted from the inlet, the polygonal apertured screen being comprised of a plurality of flat apertured screen sections forming an obtuse angle at junctures between adjacent screen sections and a deflector at one of the junctures and extending inwardly of the screen sections for substantially eliminating tangential motion of the materials being comminuted in the working chamber in a region of the working chamber adjacent the deflector.

In a further preferred embodiment according to the present invention, there is provided a hammermill for comminuting material, comprising a housing having an inlet for receiving material to be comminuted, a rotor within the housing and mounted on a driven shaft, a plurality of free-swinging hammers attached to the rotor, a polygonal apertured screen mounted about the rotor and defining a working chamber for receiving material to be comminuted from the inlet, the polygonal apertured screen being comprised of a plurality of flat apertured screen sections forming an obtuse angle at junctures between adjacent screen sections and a door on at least one side of the hammermill, a carriage carried by the door and mounting at least one screen section, a support mounting the door for movement between a closed position with the one screen section bearing against the housing and forming part of the working chamber and an open position with the one screen section spaced from the housing.

Accordingly, it is a primary object of the present invention to provide a novel and improved hammermill having, in combination, a polygonal screen and regrind deflectors for improved grinding efficiencies and/or a screen mounting system facilitating screen replacement and access to the interior of the hammermill working chamber.

BEST MODE FOR CARRYING OUT THE INVENTION

Figure 1:
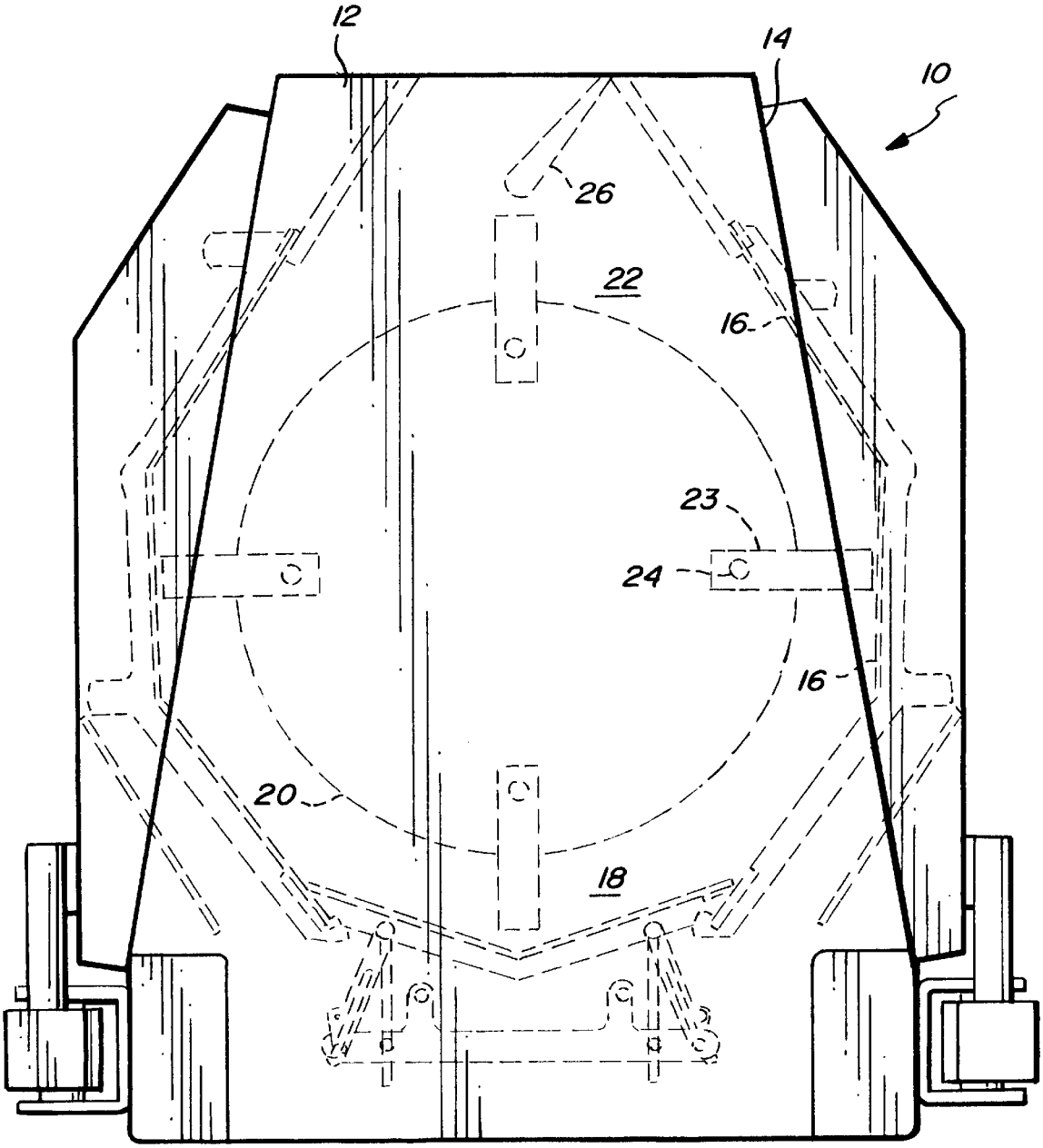
FIG. 1 is an end elevational view of a hammermill constructed in accordance with the present invention.
Figure 2:
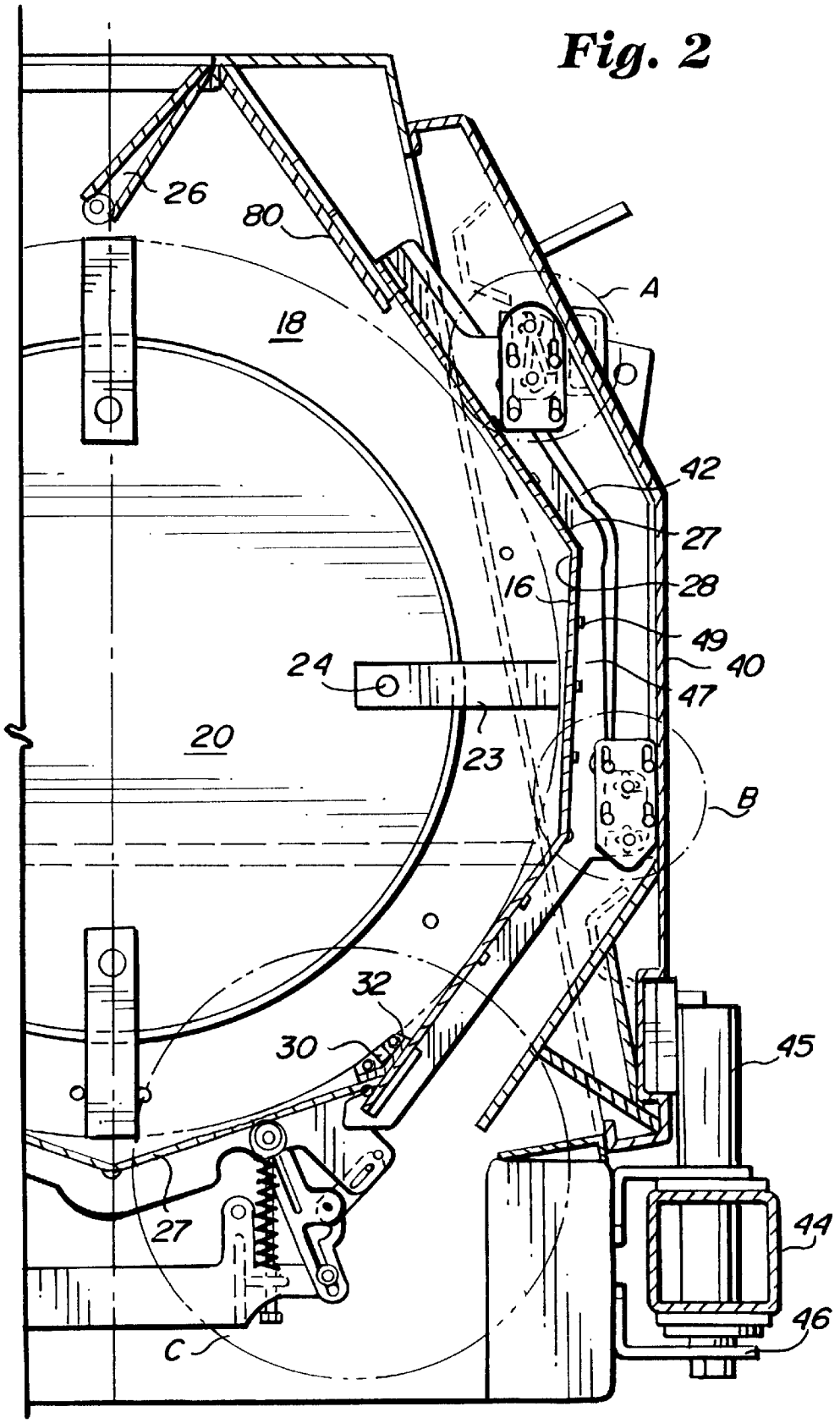
FIG. 2 is a fragmentary cross-sectional view thereof.

Referring now to the drawings, particularly to FIGS. 1 and 2, there is illustrated a hammermill, generally designated 10, having a feed material inlet 12 at the top of a housing 14. A ground particle discharge is disposed at the bottom of the housing. A screen 16 having a polygonal-shaped cross-section is disposed within housing 14 and in part defines a grinding or working chamber 18 with the rotor 20 and housing end plates 22. It will be appreciated that the rotor 20 is mounted on a shaft, not shown, for rotation and mounts a plurality of hammers 23 which are free to swing about pivot pins 24 when rotor 20 is rotated. An anti-reflux gate 26 is disposed adjacent inlet 12 to preclude feed material from being driven upwardly through the inlet by impact with the hammers 23 (assuming counterclockwise rotation as viewed in FIG. 1). It will be appreciated that during operation, feed material enters the inlet 12 and falls into the grinding chamber 18 where it is repeatedly struck by the swinging hammers 23 until ground sufficiently fine to pass through the apertures in the screen 16 for passage to the outlet.

As illustrated in FIG. 2, the polygonal screen 16 is comprised of a plurality of screen sections 27 which adjoin one another at a juncture 28 forming an obtuse angle along the interior of screen 16. While screen sections 27 may be separately fabricated, the screen sections 27 are preferably provided in groups thereof forming screen segments. In the illustration, three screen sections 27 comprise a screen segment along each of the opposite sides of the hammermill, while two screen sections 27 comprise a screen segment at the bottom of the hammermill. As will be appreciated from the ensuing description, the side screen segments are carried by doors 40 movable between open and closed positions affording, when in the open position, access to the interior of the hammermill and to the screens carried by the door for replacement.

The polygonal-shaped screen 16 improves hammer impact and crushing efficiency by reducing the acceleration of the particles in the tangential direction of hammer rotation and hence increasing the impact force of the hammers on the particles. More particularly, the polygonal screen interrupts the flow of particles tending to deflect the particles in directions other than the tangential direction of the hammers, hence increasing the particle-to-hammer speed differential and crushing efficiency as set forth in U.S. Pat. No. 5,692,688, issued Dec. 2, 1997.

Figure 9:
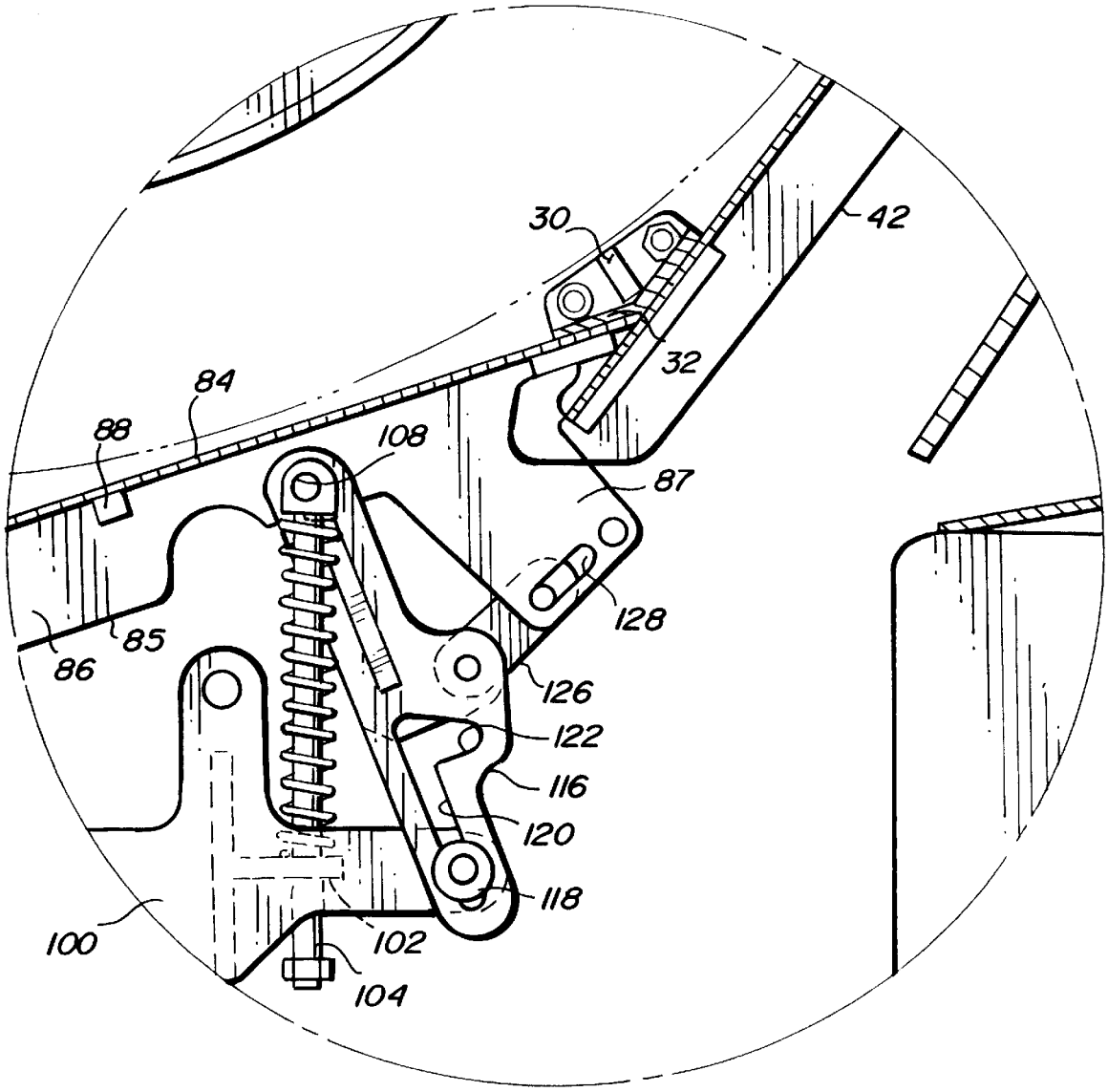
FIG. 9 is an enlarged fragmentary cross-sectional view illustrating the mounting for the lower screen carriage at circled portion C in FIG. 2.

To further increase the crushing efficiency required, deflectors 30, as illustrated in FIG. 9, are provided at the juncture of adjacent screen sections. In a preferred embodiment, the deflectors 30 are provided at the juncture of the side screen segments with the bottom screen segment. Particularly, deflector 30 comprises a plate extending radially inwardly from an elongated angled support 32 which structurally interconnects opposite ends of the housing along each of its opposite sides. Particularly, the supports 32 lie along the intersection of each side screen segment and the bottom screen segment along opposite sides of the housing. Thus, the plates 30 forming the deflectors project inwardly of the screens and from supports 32 at the apices of adjoining screen segments and into the flow of particles and air, changing the direction of the particle movement from what would otherwise be tangential to a more radial direction. This ensures that the hammers 23 impact on each particle with increased energy and consequent quicker particle size reduction. Preferably, the deflectors 30 are mounted at the juncture of the bottom and side screen segments whereby a total of two deflectors are provided. The deflectors, in combination with the polygonal shape of the screen, virtually eliminate and minimize the possibility of particles flowing tangentially about the working chamber, which would reduce the impact of the hammers on the particles and hence adversely affect particle size reduction.

Figure 3:
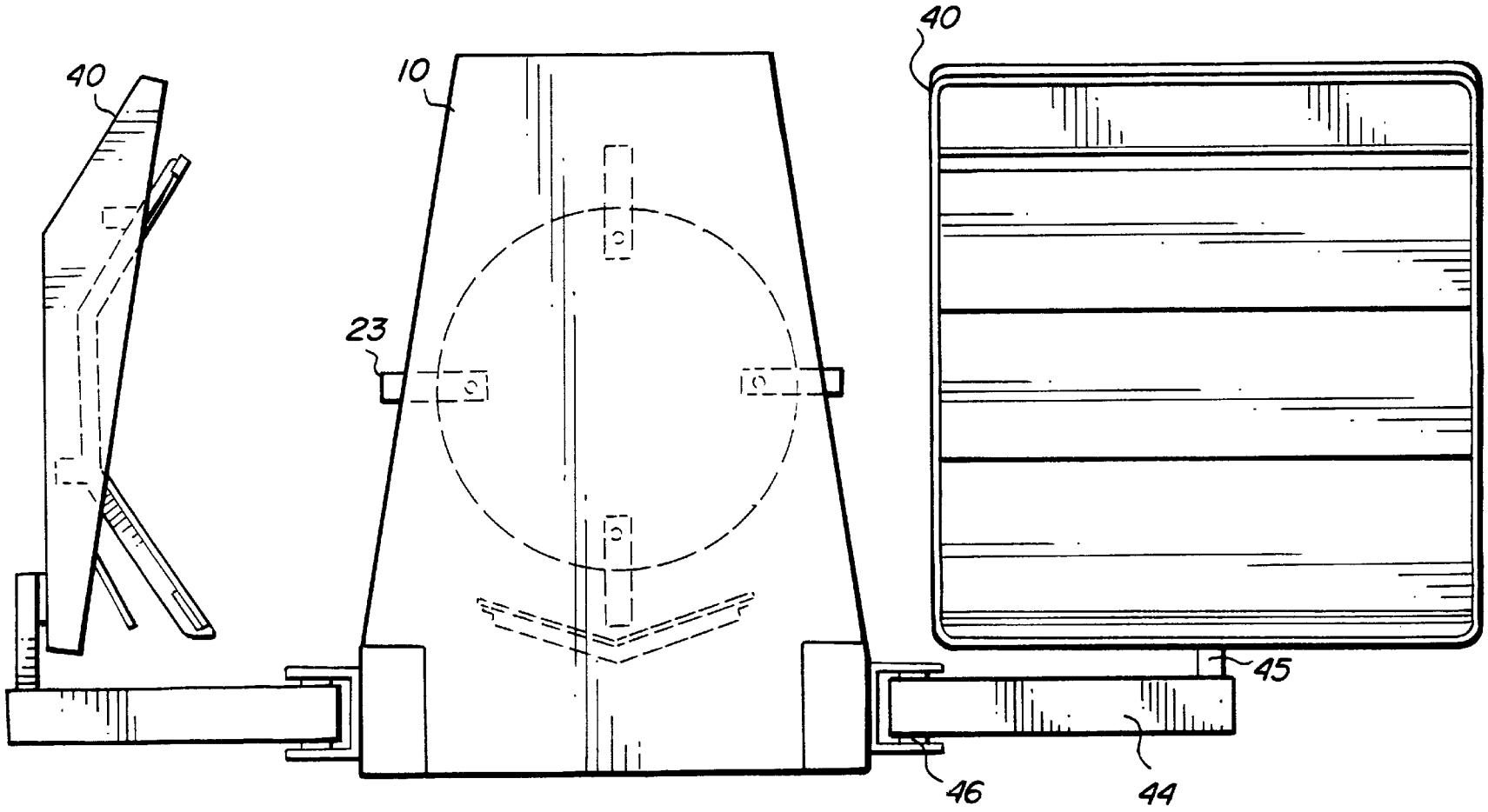
FIG. 3 is an end elevational view similar to FIG. 1 illustrating the doors and screens carried thereby in respective open positions on opposite sides of the hammermill.
Figure 5:
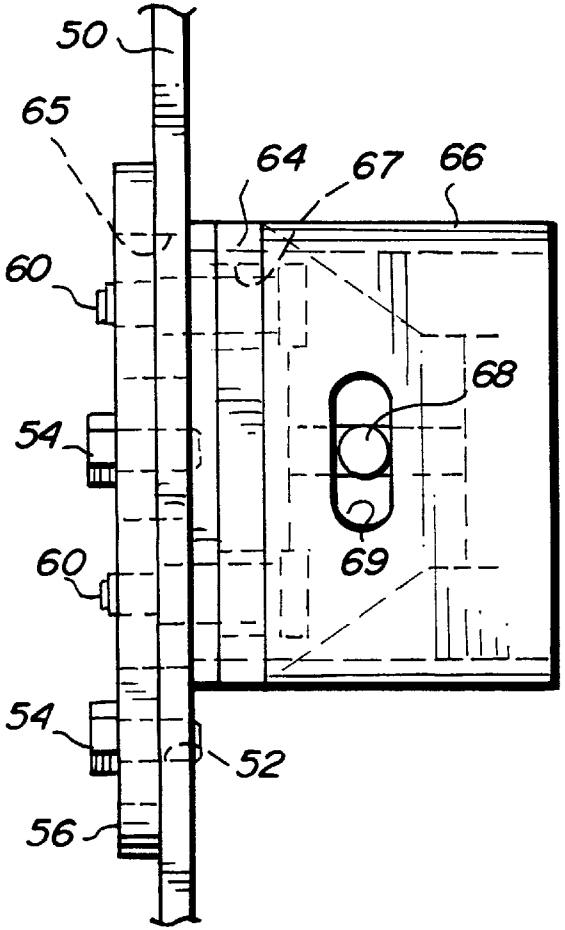
FIG. 5 is a fragmentary end view of the screen carriage and door mount of FIG. 4.
Figure 4:
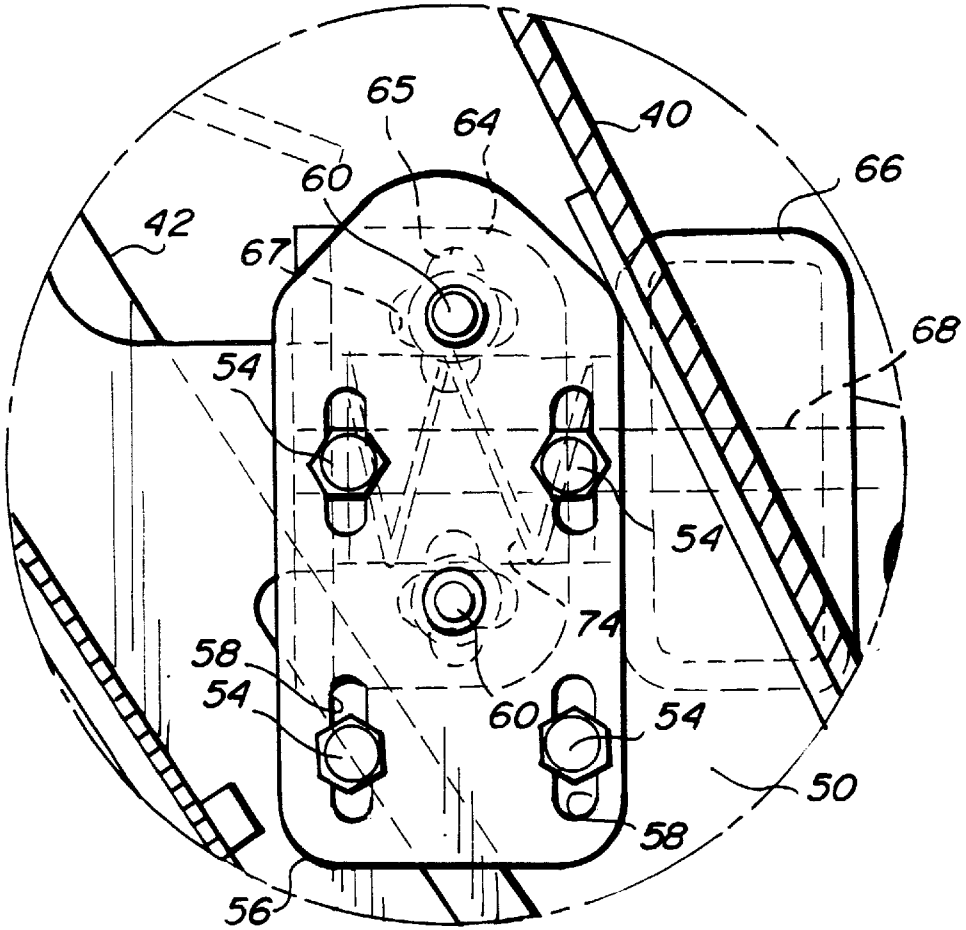
FIG. 4 is an enlarged cross-sectional view of an upper side door to screen carriage mount at the circled portion A in FIG. 2.
Figure 6:
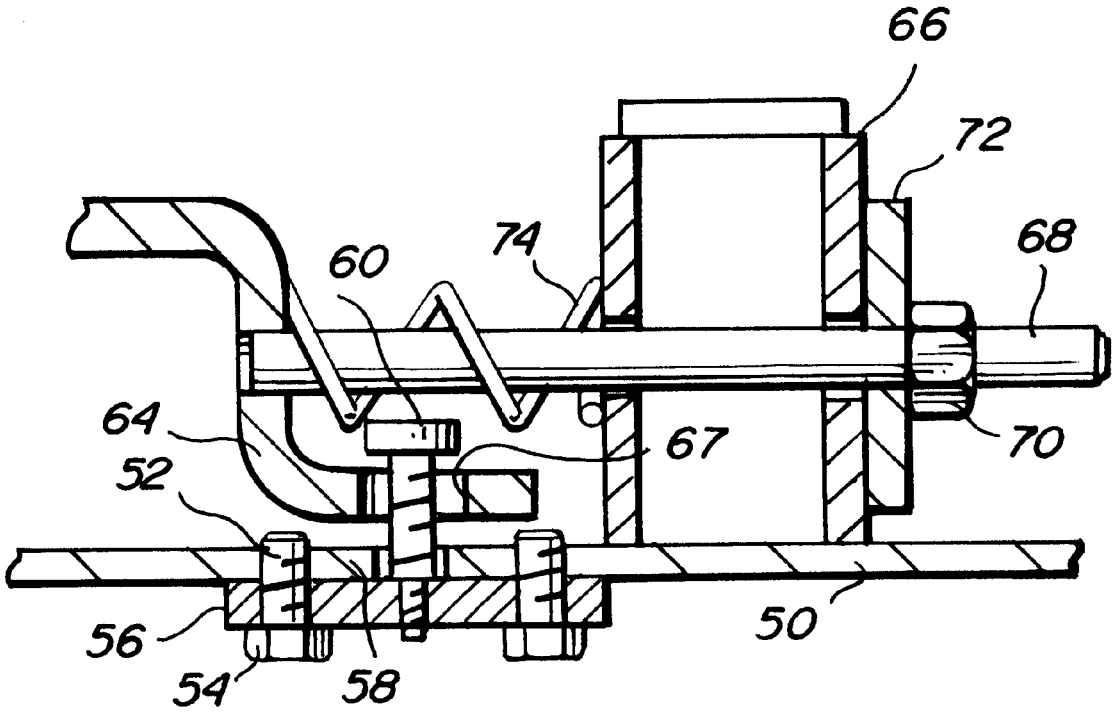
FIG. 6 is a fragmentary top plan view of the screen carriage and door mount of FIG. 4.

Referring now to FIGS. 2 and 3, hammermill 10 has a pair of doors 40 along opposite sides, each door carrying a screen carriage 42, in turn carrying the side screen segment comprising three screen sections. The doors 40 are mounted for movement in directions toward and away from the axis of rotation of the rotor and for pivotal movement about a pair of laterally spaced, generally vertical axes. Particularly, each door 40 is pivotally mounted, preferably along its mid-line, to and adjacent one end of a door support 44 and on a pivot pin 45. Support 44 is pivotally mounted at its opposite end on a hinge 46 adjacent one end of the hammermill. Thus, to open the hammermill, the doors are first unclamped from the hammermill housing and displaced generally linearly and laterally outwardly away from housing 10. The displacement is such that the door remains essentially parallel to the rotary axis until the door can be pivoted about pivot 45 into a position extending generally perpendicular to the axis of the rotor, as illustrated on the right side of FIG. 3. To close the door, door 40 is pivoted about its axis 45 into generally parallel relation to the rotor axis and support 44 is pivoted about hinge 46 to close the door about the wear-liners at opposite ends of the hammermill. The foregoing described motion of the door is conventional in hammermills of this type.

According to the present invention, however, there is a unique mounting of the screen carriage 42 on each of the doors 40 which permits the screen carriage and door to be movable relative to one another upon closing and opening the hammermill. This ensures appropriate fit between the screen carriage and the wear-liners at opposite ends of the machines, as well as enabling adjustment to various polygonal screen thicknesses. As will be appreciated, each side screen carriage 42 includes a plurality of generally vertically extending ribs 47 longitudinally spaced from one another and interconnected by longitudinally extending structural stringers 49.

Referring now to drawing FIGS. 4–8, the mounting arrangement between the doors 40 and screen carriages 42 will now be explained. At each of the opposite corners of each door, there is provided a door end plate 50 having a plurality of tapped holes 52 for receiving bolts 54 extending through a carriage lock plate 56. The lock plate 56 has a plurality of vertically elongated slots 58 for receiving the bolts 54 for adjusting the height of the screen carriage 42 relative to door 40, as will be come clear from the ensuing description.

The door end plate 50 also includes a pair of vertically elongated openings 65 for receiving shoulder bolts 60 passing through the openings 65 for threaded engagement with the carriage lock plate 56. The shoulder bolts 60 also pass through horizontally elongated openings 67 in a flange 64 projecting outwardly from and forming part of the screen carriage 42. The openings 67 through flange 64 enable the screen carriage for movement horizontally toward and away from the door. The space between flange 64 and plate 50 is maintained by the head of bolt 60 on the opposite end of side carriage 42.

The door also mounts a tube 66 which projects generally axially of the hammermill. The tube 66 has a pair of vertically elongated openings 69 for receiving a stud 68 which is secured at one end to the screen carriage and has a nut 70 at its opposite end, with a washer 72 between nut 70 and tube 66. A coil spring 74 extends about stud 68 between tube 66 and the screen carriage 42 whereby the screen carriage 42 is biased for movement laterally away from the door into its illustrated extreme position with the washer and nut engaging the tube 66. That is, springs 74 enable the screen carriage to move toward and away from the door with the openings 67 in the flanges 64 affording the range of movement.

Figure 8:
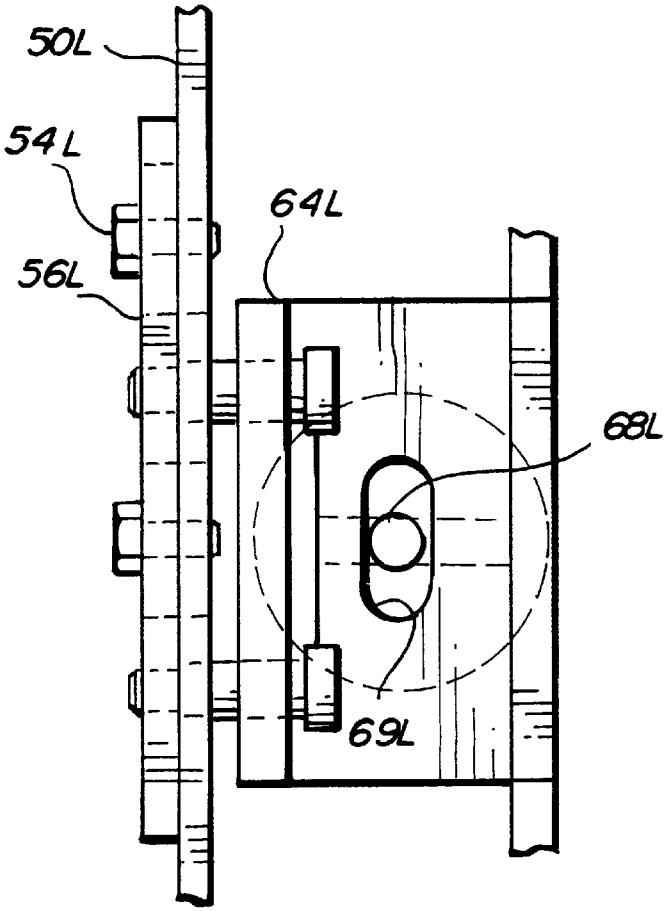
FIG. 8 is an end elevational view thereof.
Figure 7:
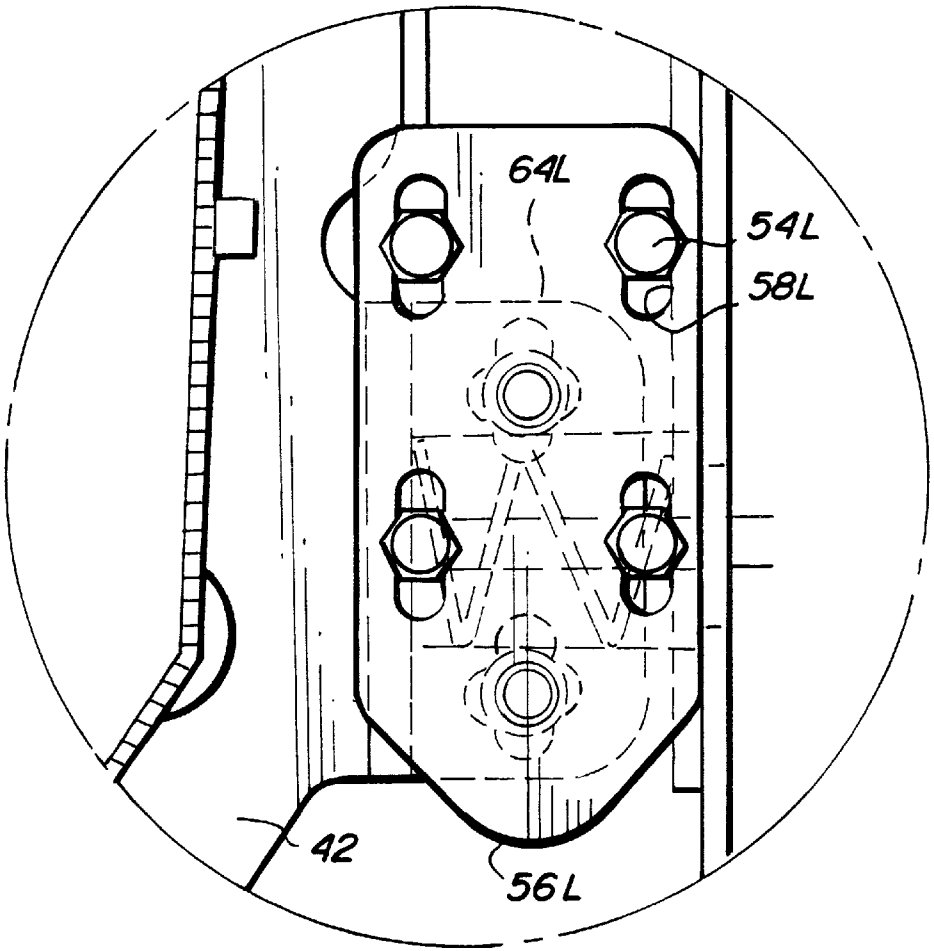
FIG. 7 is a fragmentary enlarged cross-sectional view of a lower side door to screen carriage mount at circled portion B in FIG. 2.

The lower sides of the doors and screen carriages are secured one to the other by a similar arrangement as illustrated in FIGS. 7 and 8 and like reference numerals are applied to like parts as described above followed by the suffix L. The only differences are that the lower lock plate 56L is inverted, there is no taper to the angled flange 64L and there is no tube 66. The stud 68L is secured directly to the outer skin of the door. It will be appreciated that the arrangement described is provided at four locations for each door, preferably at the upper and lower corners of the door. When the doors are moved to their closed position and the screen carriage 42 engages the wear strips at opposite ends of the housing, the door is clamped at its opposite ends to the housing by clamps, not shown. When clamping the door, the screen carriage bears against the lower angle bracket 32 and an upper support 80 with the screen carriage 42 being movable relative to the door against the bias of the springs 74. As noted previously, this accommodates different screen thicknesses and ensures complete closure of the screens about the working chamber by biasing the side screen carriages toward the housing end plates 22.

Figure 10:
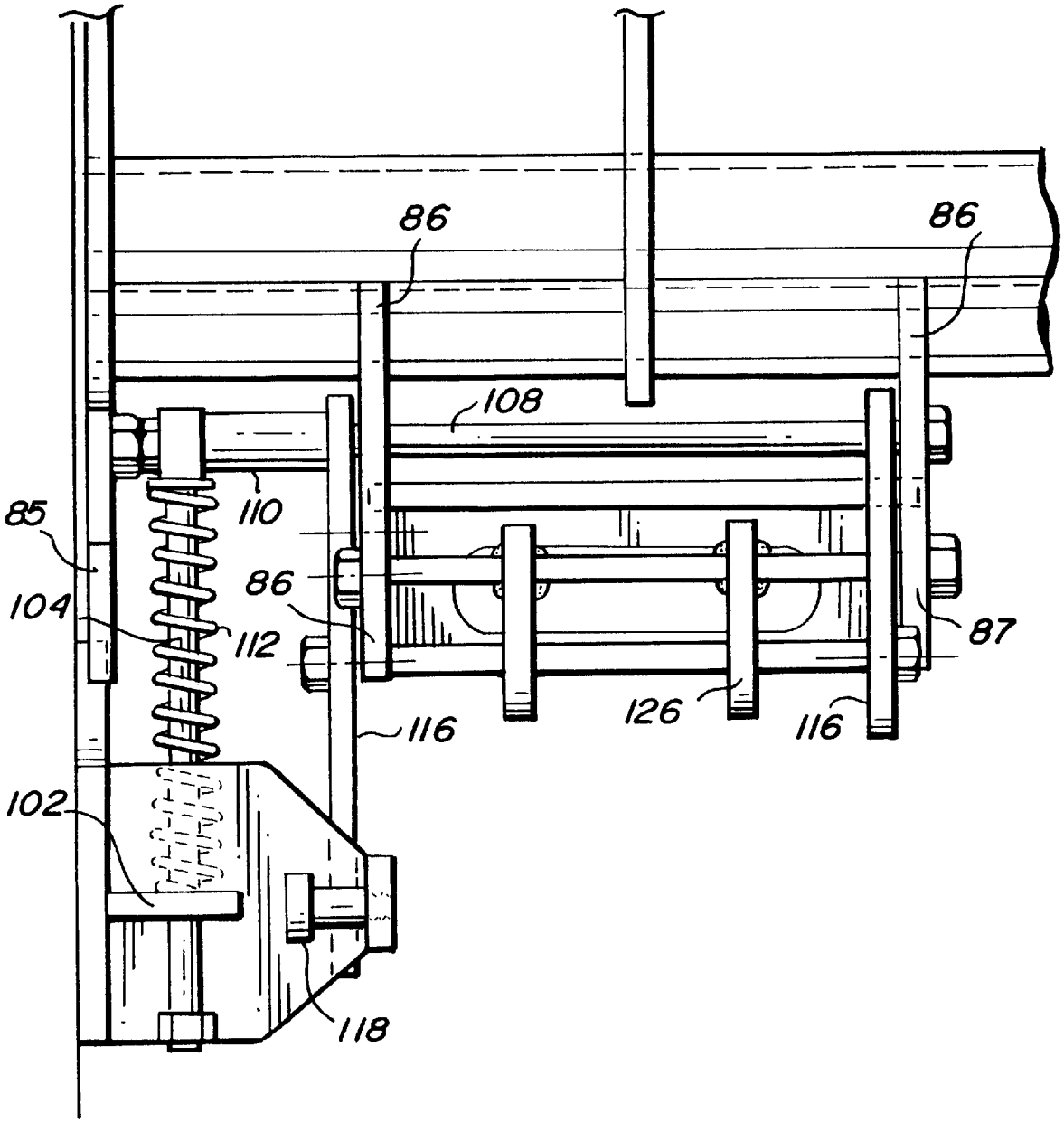
FIG. 10 is a fragmentary elevational view thereof.
Figure 11:
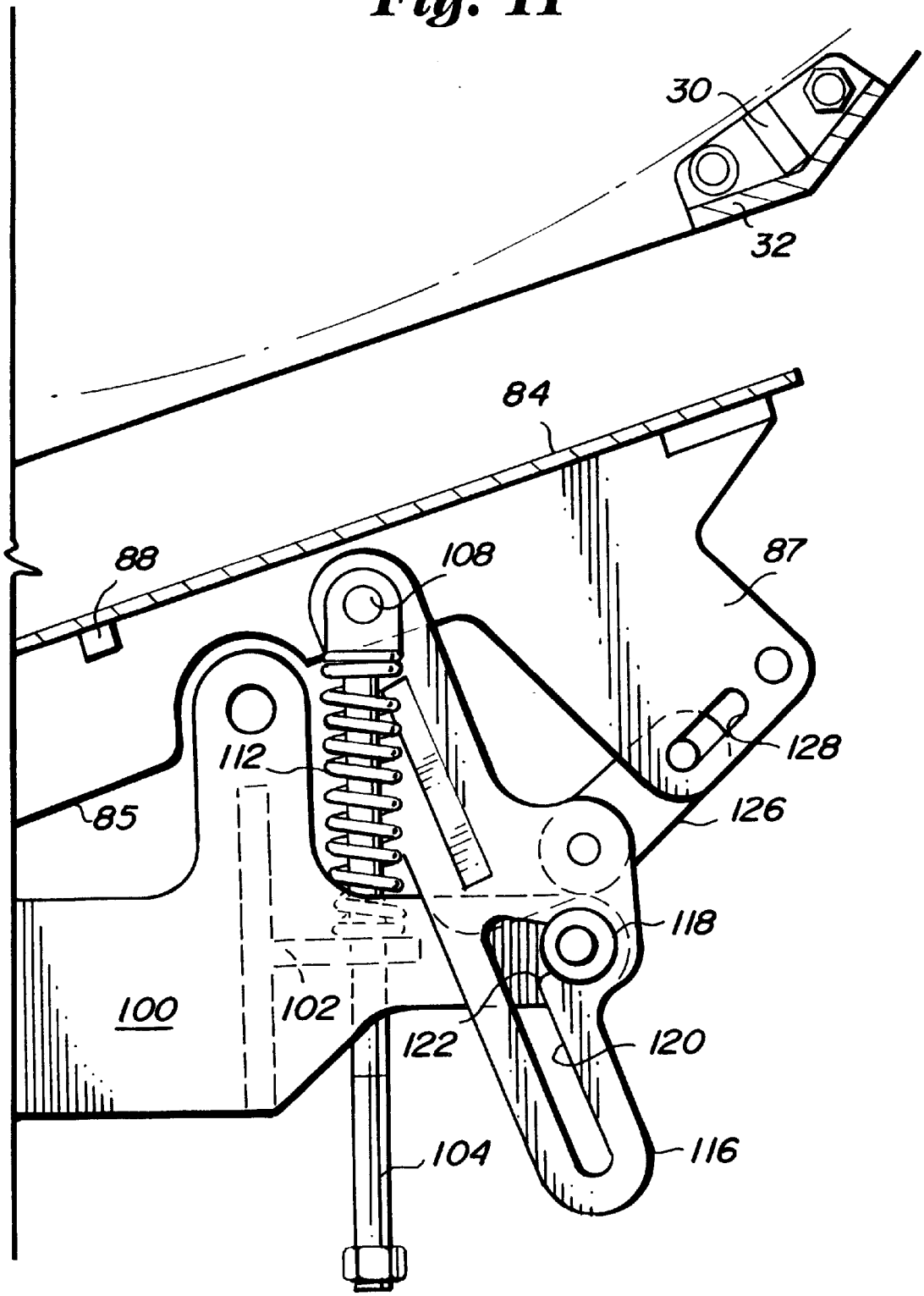
FIG. 11 is a view similar to FIG. 9 illustrating the bottom screen carriage in an open position.

Referring now to FIGS. 9, 10 and 11, the bottom screen carriage 85 carries a lower screen segment 84 comprised of screen sections. Segment 84 is carried by a plurality of longitudinally spaced ribs 86 coupled to one another by axially extending supports or stringers 88. The bottom screen carriage 85 in its closed position bears against legs of the angled supports 32 and, in its open position, as illustrated in FIG. 11, is displaced downwardly from the bottom of the working chamber. To accomplish this movement, the bottom screen carriage 85 is vertically displaceable relative to a support belly 100. The support belly 100 includes a flange 102 through which an eyebolt 104 passes. Eyebolt 104 is pivotally connected at its upper end with the bottom screen carriage 85 by a pivot pin 108 spaced from the bottom screen carriage rib 86 by a spacer 110. The bottom screen carriage 85 is biased into the closed position by a helical spring 112 about the eyebolt 104.

A latch 116 is pivotally carried at one end by the pivot pin 108 and at its opposite end by a latch bolt 118. Latch 116, as illustrated in FIG. 9, has an inclined vertical slot 120 and a lateral locking slot portion 122 of slot 120. Additionally, a link 126 pivotally interconnects the latch 116 and a flange 87 of a bottom screen carriage rib 86. The link 126 carries a pin engaging in a slot 128 of flange 87. A following latch 116 similarly engages a flange 87 of an adjacent rib 86, the latches 116 being connected by a bar.

Upon comparing FIGS. 9 and 11, it will be seen that the spring biases the bottom screen carriage into engagement with the brackets 32, maintaining the working chamber closed. To open the working chamber at the bottom, the bottom screen carriage 86 is lowered. To accomplish this, the linkage 126 is displaced downwardly against the bias of spring 112. It will be appreciated that the slot 120 of the latch 116 rides along the shank of the latch bolt 118 until it lies in registration with the slot portion 122, at which time the latch is pivoted about its upper end to engage the latch bolt 118 in the slot portion 122 to lock the bottom screen carriage in its open position, as illustrated in FIG. 11. It will be appreciated that the link has traveled toward the bottom of slot 128 of the flange 87. With the bottom screen carriage spaced from the bottom of the housing and locked in that position, the screens can be changed. The bottom screen carriage 85 can be closed by reversing the foregoing-described operation. Particularly, linkage 126 is displaced to move the latch to register the latch bolt 118 in the main slot 120 of the latch whereby the spring 112 biases the bottom screen carriage into the closed position against brackets 32 and housing end plates 22.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A hammermill for comminuting material, comprising:

a housing having an inlet for receiving material to be comminuted;

a rotor within said housing and mounted on a driven shaft;

a plurality of free-swinging hammers attached to the rotor;

a polygonal apertured screen mounted about the rotor and defining a working chamber for receiving material to be comminuted from said inlet, the polygonal apertured screen being comprised of a plurality of flat apertured screen sections forming an obtuse angle at junctures between adjacent screen sections; and a deflector at one of said junctures and extending inwardly of said screen sections for substantially eliminating tangential motion of the materials being comminuted in the working chamber in a region of the working chamber adjacent said deflector.

2. A hammermill according to claim 1 wherein said screen sections are provided in groups of at least two sections each.

3. A hammermill according to claim 1 wherein said deflector comprises a bar extending parallel to an axis of rotation of the rotor and extending inwardly of said screen short of tips of said hammers fully extended upon rotation of the rotor.

4. A hammermill according to claim 1 including a door on at least one side of said hammermill, a carriage carried by said door and mounting at least one screen section, a support mounting said door for joint movement with said one screen section and said carriage between a closed position with said one screen section bearing against said housing and forming part of said working chamber and an open position with said one screen section and said carriage spaced from said housing and carried by said door.

5. A hammermill according to claim 4 wherein said door is pivotally carried by said support and said support is pivotally carried by said housing enabling said door to move away from its closed position in a first direction generally normal to the axis of said driven shaft.

6. A hammermill according to claim 5 wherein said door is pivotal relative to said support to enable the screen carried by said carriage to be oriented substantially at a right angle relative to the position of the screen in the closed position of the door.

7. A hammermill according to claim 4 wherein said door includes biasing elements for biasing said carriage and screen carried thereby away from said door and against said housing when said door lies in said closed position.

8. A hammermill according to claim 7 wherein said carriage and screen carried by said door bear against said housing in said closed position of said door responsive solely to the bias of said biasing elements and without attachment of said carriage and screen carried thereby to said housing otherwise than by said door.

9. A hammermill according to claim 1 including a door on opposite sides of said hammermill, a carriage carried by each of said doors and mounting at least a pair of said screen sections, supports carried by said housing on opposite sides thereof for mounting said doors, each said door being mounted for joint movement with a pair of said screen sections between a closed position with the pair of screen sections bearing against a side of said housing and an open position spaced from said housing side, said screen sections being releasably secured to said doors in said open positions thereof so that the screen sections can be replaced.

10. A hammermill according to claim 9 wherein each of said doors is pivotally carried by a respective support and said support is pivotally carried by said housing enabling said doors to move away from their closed positions in a first direction generally normal to the axis of said driven shaft.

11. A hammermill according to claim 10, wherein each said door is pivotal relative to said support to enable the screen sections carried by said carriage to be oriented substantially at right angles relative to the position of the screen sections in the closed position of the door.

12. A hammermill for comminuting material, comprising:

a housing having an inlet for receiving material to be comminuted;

a rotor within said housing and mounted on a driven shaft;

a plurality of free-swinging hammers attached to the rotor;

a polygonal apertured screen mounted about the rotor and defining a working chamber for receiving material to be comminuted from said inlet, the polygonal apertured screen being comprised of a plurality of flat apertured screen sections forming an obtuse angle at junctures between adjacent screen sections; and a door on at least one side of said hammermill, a carriage carried by said door and mounting at least one screen section, a support mounting said door for joint movement with said one screen and said carriage between a closed position with said one screen section bearing against said housing and forming part of said working chamber and an open position with said one screen section and said carriage spaced from said housing and carried by said door.

13. A hammermill according to claim 12 wherein said door is pivotally carried by said support and said support is pivotally carried by said housing enabling said door to move away from its closed position in a first direction generally normal to the axis of said driven shaft.

14. A hammermill according to claim 13 wherein said door is pivotal relative to said support to enable said one screen carried by said carriage to be oriented substantially at a right angle relative to the position of the screen in the closed position of the door.

15. A hammermill according to claim 12 wherein said door includes biasing elements for biasing said carriage and screen carried thereby away from said door and against said housing when said door lies in said closed position.

16. A hammermill according to claim 15 wherein said carriage and screen carried by said door bear against said housing in said closed position of said door responsive solely to the bias of said biasing elements and without attachment of said carriage and screen carried thereby to said housing otherwise than by said door.

17. A hammermill according to claim 12 including a door on opposite sides of said hammermill, a carriage carried by each of said doors and mounting at least a pair of said screen sections, supports carried by said housing on opposite sides thereof for mounting said doors, each said door being mounted for movement between a closed position with the pair of screen sections bearing against a side of said housing and an open position spaced from said housing side, said screen sections being releasably secured to said doors so that the screen sections can be replaced.

18. A hammermill for comminuting material, comprising:

a housing having an inlet for receiving material to be comminuted;

a rotor within said housing and mounted on a driven shaft;

a plurality of free-swinging hammers attached to the rotor;

an apertured screen mounted about the rotor and defining a working chamber for receiving material to be comminuted from said inlet; and a door on at least one side of said hammermill, a carriage carried by said door and removably mounting said screen, a support mounting said door for movement between a closed position with said screen bearing against said housing and forming part of said working chamber and an open position with said screen spaced from said housing and carried by said open door, said carriage being mounted for movement relative to said door, and biasing elements for biasing said carriage and screen carried thereby away from said door and against said housing when said door lies in said closed position.

19. A hammermill for comminuting material, comprising:

a housing having an inlet for receiving material to be comminuted;

a rotor within said housing and mounted on a driven shaft;

a plurality of free-swinging hammers attached to the rotor;

a polygonal apertured screen mounted about the rotor and defining a working chamber for receiving material to be comminuted from said inlet, the polygonal apertured screen being comprised of a plurality of flat apertured screen sections forming an obtuse angle at junctures between adjacent screen sections;

a deflector at one of said junctures and extending inwardly of said screen sections for substantially eliminating tangential motion of the materials being comminuted in the working chamber in a region of the working chamber adjacent said deflector; and a bottom screen carriage mounted on said housing for movement toward and away from said housing in positions respectively closing and opening said housing, resilient elements biasing said bottom screen carriage into said closed position, and a latch mechanism for locking said bottom screen carriage in an open position spaced from said housing.

20. A hammermill according to claim 19 wherein said bottom screen carriage carries a pair of adjacent screen sections forming an obtuse angle relative to one another, a pair of brackets extending between opposite ends of said housing and in part defining said working chamber, a deflector carried by each of said brackets and extending inwardly for substantially eliminating tangential motion of the materials being comminuted in the working chamber in the region of the working chamber adjacent said deflectors, said bottom screen sections bearing against said brackets in their closed positions.

21. A hammermill for comminuting material, comprising:

a housing having an inlet for receiving material to be comminuted;

a rotor within said housing and mounted on a driven shaft;

a plurality of free-swinging hammers attached to the rotor;

a polygonal apertured screen mounted about the rotor and defining a working chamber for receiving material to be comminuted from said inlet, the polygonal apertured screen being comprised of a plurality of flat apertured screen sections forming an obtuse angle at junctures between adjacent screen sections;

a door on at least one side of said hammermill, a carriage carried by said door and mounting at least one screen section, a support mounting said door for movement between a closed position with said one screen section bearing against said housing and forming part of said working chamber and an open position with said one screen section spaced from said housing; and a bottom screen carriage mounted on said housing for movement toward and away from said housing in positions respectively closing and opening said housing, resilient elements biasing said bottom screen carriage into said closed position, and a latch mechanism for locking said bottom screen carriage in an open position spaced from said housing.

22. A hammermill according to claim 21 wherein said bottom screen carriage carries a pair of adjacent screen sections forming an obtuse angle relative to one another, a pair of brackets extending between opposite ends of said housing and in part defining said working chamber, a deflector carried by each of said brackets and extending inwardly for substantially eliminating tangential motion of the materials being comminuted in the working chamber in the region of the working chamber adjacent said deflectors, said bottom screen sections bearing against said brackets in their closed positions.

* * * * *